US007702121B2

(12) United States Patent
Husung et al.

(10) Patent No.: US 7,702,121 B2
(45) Date of Patent: Apr. 20, 2010

(54) ACOUSTIC SYSTEM WITH AUTOMATIC SWITCHOVER

(75) Inventors: Kunibert Husung, Erlangen (DE); Tom Weidner, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1185 days.

(21) Appl. No.: 11/283,899

(22) Filed: Nov. 21, 2005

(65) Prior Publication Data

US 2006/0109994 A1 May 25, 2006

(30) Foreign Application Priority Data

Nov. 24, 2004 (DE) ..... 10 2004 056 733

(51) Int. Cl.
*H04R 25/00* (2006.01)

(52) U.S. Cl. ..... 381/316; 381/312

(58) Field of Classification Search ..... 381/316, 381/312

See application file for complete search history.

(56) References Cited

U.S. PATENT DOCUMENTS 6,587,568 B1 7/2003 Sigwanz
6,694,034 B2 * 2/2004 Julstrom et al. ..... 381/315
6,763,116 B2 7/2004 Barthel et al.
2003/0133582 A1 7/2003 Niederdrank
2005/0078842 A1 * 4/2005 Vonlanthen et al. ..... 381/316
2005/0111680 A1 * 5/2005 Meier et al. ..... 381/312

FOREIGN PATENT DOCUMENTS

EP 1 328 136 A2 7/2003
WO WO 00/10363 A1 2/2000
WO WO 2004/028203 A2 4/2004

* cited by examiner

*Primary Examiner*—Brian Ensey

(57) ABSTRACT

The automatic switching of acoustic systems and especially of hearing aids into different processing programs is to be improved. To this end there is provision for the signal processing device of the acoustic system to feature a high-frequency detector for analysis of an input signal, with the output signal of said device being able to be used for processing one or more input signals by the signal processing unit. Specifically the presence of an active mobile telephone which emits electromagnetic radiation in the high-frequency range can be established in this way. This enables the system to be switched into telephone made with a high degree of certainty to suit a particular situation.

16 Claims, 1 Drawing Sheet

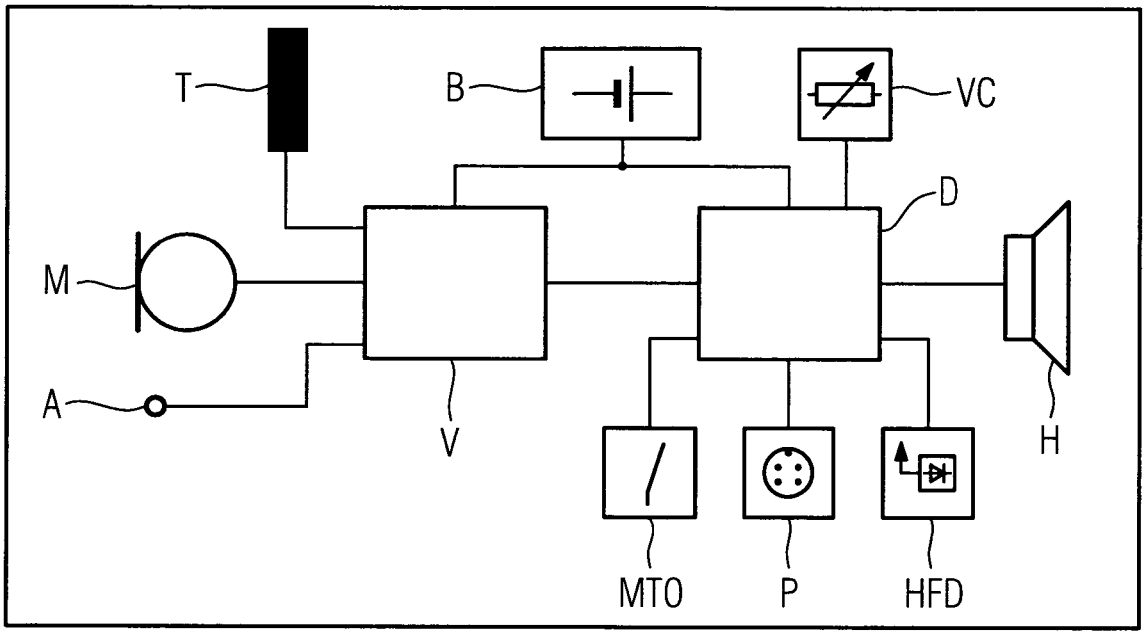
T
B
VC
D
M
A
V
H
MTO
P
HFD

ACOUSTIC SYSTEM WITH AUTOMATIC SWITCHOVER

CROSS REFERENCE TO RELATED APPLICATIONS

This application claims priority to the German application No. 10 2004 056 733.6, filed Nov. 24, 2004 which is incorporated by reference herein in its entirety.

FIELD OF INVENTION

The present invention relates to an acoustic system, especially to a hearing aid with a microphone device, a loudspeaker device, a signal processing device for accepting a first input signal from the microphone device and for output of an output signal to the loudspeaker device as well as a receive device for receiving electromagnetic signals and for output of a second input signal to the signal processing device.

BACKGROUND OF INVENTION

Hearing aids can usually be switched manually into a corresponding hearing program depending on the situation involved. The switchover between the programs is typically actuated by pressing a button. Manual switching is inconvenient and is very often involves a delay so that the beginning of a communication cannot be detected for example.

For this reason hearing aids have been developed which are able to switch automatically into a corresponding hearing program. A hearing aid of this type is known from publication U.S. Pat. No. 6,763,116 B2. In this invention the acoustic signal picked up is investigated for interference or noise components. Depending on the analysis of the noise signals transmission parameters are modified or complete hearing programs are switched over.

The analysis of the signals in accordance with noise components however involves considerable effort and the result is often not clear.

SUMMARY OF INVENTION

An object of the present invention thus consists of improving the automatic switchover of acoustic systems or hearing devices on the basis of the received signals.

In accordance with the invention this object is achieved by the claims.

In an advantageous manner a control signal is thus used for signal processing which a corresponding acoustic system according to the prior art does not receive or process at all.

Preferably frequency components above 1 MHz are detected with the high-frequency detector. This enables electromagnetic signals of mobile telephones to be captured, so that for example a hearing aid can be switched over to an appropriate telephone program.

In accordance with a further development modulations of high-frequency signals can be detected with the high-frequency detector. In this way very specific signals can be detected, so that hearing aid programs can be switched in a very differentiated manner.

Specifically the receive device can be designed for receiving GSM, UMTS and/or Bluetooth signals. In addition the receive device can also be equipped for receiving signals of a cordless telephone. The detection of these signals enables very specific processing on automatic paths.

As already indicated, the signal processing device can be switched depending on the output signal of the high-frequency detector into a relevant processing program. This automatic switchover not only enhances the convenience of the acoustic system, but also, under some circumstances, enables a greater number of switching programs to be provided which under some circumstances could not be selected by manual switchover.

A particular advantage of an inventive acoustic systems or method emerges for binaural supply to a patient. In this case a level measuring device can be built into the signal processing device of one of the two hearing aids or of both hearing aids in order to determine the level or the level difference of the output signal of the high frequency detector for further signal processing. This is a way of determining for example whether an electromagnetic near field or far field is present. The signal processing can be switched accordingly.

BRIEF DESCRIPTION OF THE DRAWING

The present invention will now be explained in greater detail with reference to the enclosed drawing which shows a basic circuit diagram of a hearing aid in accordance with the invention.

DETAILED DESCRIPTION OF INVENTION

The exemplary embodiment described in greater detail below represents a preferred embodiment of the present invention.

The hearing aid shown schematically on the basis of a circuit diagram in FIG. 1 has a microphone M, an audio input A and a telephone coil T. A preamplifier V picks up the signals of the audio input A, of the microphone M and of the telephone coil T. In addition the preamplifier V has an A/D converter and a voltage regulator.

A digital signal processing unit D with clocked final stage accepts the signal of the preamplifier V. Both units, the preamplifier V and also the digital signal processing unit D are supplied with power from a battery B. Furthermore a volume control VC for adjusting the volume and a programming socket P for programming the hearing aid are connected to the digital signal processing unit D. An MTO switch MTO can be used to switch the digital signal processing unit D into a microphone mode, a telephone mode or to switch it off.

Furthermore an HF detector HFD is connected to the digital signal processing unit D. This analyzes the signals in the high-frequency range. The HF detector can feature a receive device of its own or receive the signals of a receive device that can be used in another way e.g. a telephone coil.

In the digital signal processing unit D the signal of the preamplifier V is processed in accordance with the manually or automatically selected hearing program or the parameters thus selected. The resulting output signal is forwarded to an earpiece H. Alternatively electrodes, oscillating coils, vibration generators etc. can also be provided as output devices.

The high-frequency detector HFD evaluates in the hearing system a GSM signal emitted at around 960 MHz or 1.8 GHz for example. This signal has been emitted in the immediate vicinity of the hearing aid by a mobile radio device and picked up by the antenna of the HF detector HFD. If the level of the GSM signal exceeds a predetermined threshold value, this indicates that a GSM mobile radio device is being used by the hearing aid wearer. Accordingly the hearing aid switches into the telephone program (hearing loop program) for example or into a correspondingly adapted microphone program.

Alternatively UMTS signals, Bluetooth signals or signals of a cordless telephone in the range of 2.4 GHz or 1.8 to 1.9 GHz can also be received with the HF detector HFD for example.

To increase the certainty with which a corresponding sending system is detected, specific modulations can be searched for in the signal picked up in each case. If for example UMTS-specific modulations are detected, a switchover to telephone mode can be made since the hearing aid wearer is sure to be currently using a UMTS telephone. Bluetooth transmitters which transmit in a frequency range closely adjacent to the UMTS frequency band do not use the UMTS-specific modulations.

Advantageously a manual switchover is thus no longer needed and complicated algorithms for automatic switchover do not have to be used.

The sensitivity of the high-frequency detector HFD can be set so that, for binaural supply, no program switchover occurs in the second hearing aid.

If a hearing aid wearer who is supplied binaurally holds a mobile telephone to his ear, the level of the high-frequency signal which is radiated from the mobile telephone is higher at one hearing aid than at the other. This level difference indicates that a telephone is being used in this situation so that the hearing aid which registers the high level can be switched into the telephone mode. The near field detected by the two hearing aids can also be used for unique switching of the hearing aid.

If on the other hand a far field is present, the electromagnetic levels in both hearing aids are about the same size. In such a situation it would be incorrect to switch into the telephone mode. This near field-far field distinction allows increased noise immunity to be achieved for the linked hearing aids.

The invention claimed is:

1. A hearing aid system, comprising first and second hearing aids, the first and second hearing aids each comprising:

a microphone device;

an output device;

a signal processing device for picking up a first input signal generated by the microphone device and for outputting an output signal to the output device; and a receiver device for receiving electromagnetic signals and for outputting a second input signal to the signal processing device, wherein the signal processing device:

comprises a high-frequency detector for analyzing the second input signal output to the signal processing device, and is configured to generate an output signal for controlling the signal processing device based on the analyzed second input signal, wherein the signal processing device of either the first or second acoustic system comprises a signal measurement device for determining a level of or a level difference between the output signals generated by the high-frequency detectors of the first and second acoustic systems, the level or level difference used for adjusting signal processing.

2. The hearing aid system in accordance with claim 1, wherein the high-frequency detector is configured to detect frequency components above 1 MHz.

3. The hearing aid system in accordance with claim 1, wherein the high-frequency detector is configured to detect a modulation of high-frequency components.

4. The hearing aid system in accordance with claim 1, wherein the receiver device is configured to receive GSM, UMTS or Bluetooth signals.

5. The hearing aid system in accordance with claim 1, wherein the receiver device is configured to acquire signals generated by a cordless telephone.

6. The hearing aid system in accordance with claim 1, wherein the signal processing device comprises a plurality of signal processing programs, and the output signal of the high-frequency detector is configured to switch the signal processing device into a desired signal processing program based on the analyzed second input signal.

7. The hearing aid in accordance with claim 1, wherein the hearing aid system is configured to transmit between the first and second hearing aids information processed by the high-frequency detectors of the first and second hearing aids.

8. A method of operating an acoustic system, comprising:

processing a first input signal generated by a microphone device;

processing a second input signal generated by a receiver device configured to receive electromagnetic signals; and analyzing the second input signal with regard to high-frequency components included in the second input signal, wherein the first input signal is processed based on the analyzed second input signal, further comprising determining a level of or a level difference between received high-frequency signals by a first and a second hearing aid for identifying an electromagnetic near or far field based on the determined level or level difference.

9. The method according to claim 8, wherein the acoustic system is a hearing aid system.

10. The method according to claim 8, further comprising:

processing a signal generated by a telephone coil based on the analyzed second input signal; and generating an output signal of the acoustic system, the output signal including the processed signal generated by the telephone coil.

11. The method in accordance with claim 10, wherein the acoustic system comprises a plurality of signal processing programs, and the output signal is configured to switch the acoustic system into a desired signal processing program based on the analyzed second input signal.

12. The method according to claim 8, wherein the high frequency components have a frequency above 1 MHz.

13. The method according to claim 8, wherein the second input signal is analyzed with regard to a modulation of the high-frequency components.

14. The method according to claim 8, wherein the electromagnetic signals include GSM, UMTS or Bluetooth signals.

15. The method according to claim 8, wherein the electromagnetic signals include DECT signals generated by a cordless telephone.

16. The method according to claim 8, wherein the acoustic system is configured to transmit between the first and second hearing aids information processed by high-frequency detectors of the first and second hearing aids.

* * * * *